US007172141B2

(12) United States Patent
Nakayama et al.

(10) Patent No.: US 7,172,141 B2
(45) Date of Patent: Feb. 6, 2007

(54) LUBRICANT MIST SPRAYER FOR PINCH ROLL

(75) Inventors: Isamu Nakayama, Kanagawa (JP); Katsumi Nakayama, Kanagawa (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 134 days.

(21) Appl. No.: 10/490,740

(22) PCT Filed: Jul. 24, 2003

(86) PCT No.: PCT/JP03/09383

§ 371 (c)(1),
(2), (4) Date: Apr. 8, 2004

(87) PCT Pub. No.: WO2004/016372

PCT Pub. Date: Feb. 26, 2004

(65) Prior Publication Data

US 2005/0001073 A1 Jan. 6, 2005

(30) Foreign Application Priority Data

Aug. 12, 2002 (JP) ..... 2002-234997

(51) Int. Cl.
*B05B 1/14* (2006.01)

(52) U.S. Cl. ..... 239/550; 239/557; 239/566; 239/600; 164/472; 72/42

(58) Field of Classification Search ..... 239/550, 239/557, 566; 164/472, 448, 444, 447, 72; 72/42, 43, 44

See application file for complete search history.

(56) References Cited

U.S. PATENT DOCUMENTS

| | | | | |
|---|---|---|---|---|
| 3,753,793 A | | 8/1973 | Wagener et al. | |
| 4,132,096 A | * | 1/1979 | Seaton et al. | 72/13.4 |
| 4,424,855 A | | 1/1984 | Tsubakihara et al. | |
| 4,671,091 A | * | 6/1987 | Atack et al. | 72/45 |
| 4,892,133 A | * | 1/1990 | Solignac | 164/452 |
| 5,638,893 A | * | 6/1997 | Sankaran et al. | 164/472 |

FOREIGN PATENT DOCUMENTS

| | | |
|---|---|---|
| DE | AS 2053947 | 11/1970 |
| DE | 3127348 A1 | 7/1981 |
| EP | 726 112 | 8/1996 |
| EP | 780 177 | 6/1997 |
| JP | 63-026240 | 2/1988 |
| JP | 63-030158 | 2/1988 |
| JP | 1989-139959 | 9/1989 |
| JP | 4-279260 | 10/1992 |
| WO | 02/11924 | 2/2002 |

* cited by examiner

*Primary Examiner*—Dinh Q. Nguyen
(74) *Attorney, Agent, or Firm*—Oblon, Spivak, McClelland, Maier & Neustadt, P.C.

(57) ABSTRACT

A lubricant mist sprayer is composed by spray headers, which have lubricant and gas supply pipes integrally fixed to each other by fixing members and which are spaced apart a required distance from and are arranged in parallel with surfaces of pinch rolls, and mist nozzles which are arranged at required intervals longitudinally of the spray headers for spraying lubricant mist m over the surfaces of the pinch rolls and which communicate with the lubricant and gas supply pipes so as to make the lubricant mist sprayer compact in size and facilitate arrangement of the lubricant mist sprayer in a narrow space of a roll chamber surrounding the pinch rolls in a metal strip continuous caster.

2 Claims, 6 Drawing Sheets

LUBRICANT MIST SPRAYER FOR PINCH ROLL

TECHNICAL FIELD

The present invention relates to a lubricant mist sprayer for a pinch roll in a metal strip continuous caster. More specifically, it relates to a lubricant mist sprayer for a pinch roll in a twin roll continuous caster; however, the invention does not limited thereto.

BACKGROUND ART

Conventionally, various twin roll continuous casters have been proposed as means for continuously casting metal strip from molten metal.

FIG. 1 shows a strip caster (twin roll continuous caster) disclosed in JP-63-26240A and JP-63-30158A in which reference numerals 1*a* and 1*b* denote a pair of inner-cooled casting rolls horizontally arranged side by side in parallel with each other so as to have a nip. Arranged just above the casting rolls 1*a* and 1*b* are a tundish 3 and side weirs 3*a* to provide a molten metal pool 2 between the rolls 1*a* and 1*b*. With the molten metal pool 2 being provided between the rolls 1*a* and 1*b*, the rolls 1*a* and 1*b* on the left and right sides in FIG. 1 are concurrently rotated clockwise and counter-clockwise, respectively, so that the metal solidifies between the rolls 1*a* and 1*b* into a hot strip 4 with thickness corresponding to the nip between the rolls 1*a* and 1*b* and continuously delivered downward of the rolls 1*a* and 1*b*.

Reference numerals 5*a* and 5*b* denote a pair of guide pinch roll trains which are arranged just below the rolls 1*a* and 1*b* to pinch thickness-wise the hot strip 4 delivered downward from the rolls 1*a* and 1*b*. Reference numeral 6 designates a strip guide member in the form of a curved plate when seen sidewise. The guide member 6 is arranged below the pinch roll trains 5*a* and 5*b* to horizontally guide the strip delivered downward from the pinch roll trains 5*a* and 5*b*.

Reference numeral 7 denotes a pinch roll unit with pinch rolls 7*a* and 7*b* which are arranged downstream of the guide member 6 in the direction of travel of the strip to pinch thickness-wise and convey the strip 4 guided horizontally by the guide member 6.

Reference numeral 8 designates a coiler arranged downstream of the pinch roll unit 7 to wind the strip 4 horizontally fed from the pinch rolls 7*a* and 7*b*.

The above-mentioned travel path of the strip 4, which is constituted by lower halves of the rolls 1*a* and 1*b*, the pinch roll trains 5*a* and 5*b*, the guide member 6, the pinch roll unit 7 and the coiler 8, is provided within a large-sized gas chamber 9 which accommodates nozzles 10*a* and 10*b* arranged between the guide member 6 and the pinch roll unit 7 to confront upper and lower surfaces of the strip 4. The nozzles 10*a* and 10*b* are connected via supply pipes 11*a* and 11*b* to a gas supply 12; and the gas chamber 9 is connected via feed pipes 13*a* and 13*b* to a gas supply 14.

More specifically, in the twin roll continuous caster of FIG. 1, non-oxidative gas such as nitrogen gas is fed from the gas supply 14 via the supply pipes 13*a* and 13*b* to the gas chamber 9 to make an interior of the gas chamber 9 into non-oxidative gas atmosphere. The nitrogen gas is injected through the nozzles 10*a* and 10*b* via the supply pipes 11*a* and 11*b* to suppress formation of scales (oxide layer) on the surface of the strip 4. The temperature of the strip 4 is about 1400° C. when delivered from the rolls 1*a* and 1*b* and lowers to about 1000° C. when coming close to the pinch roll unit 7.

As mentioned above, in a metal strip continuous caster, scales must be prevented from being generated on a hot strip produced. To this end, in addition to the system shown in FIG. 1 where the travel path of the strip 4 is wholly enclosed by the large-sized gas chamber 9 to maintain non-oxidative gas atmosphere, various systems have been envisaged. For example, with the travel path of the strip 4 being divided into two at the pinch rolls 7*a* and 7*b*, the strip 4 may be enclosed by upstream and downstream gas chambers as well as a roll chamber for the pinch rolls 7*a* and 7*b*. In the case of a metal strip continuous caster having.a rolling mill at a subsequent stage (downstream) of the pinch roll unit 7 being utilized, the gas chamber may extend just before the rolling mill. Alternatively, gas chambers may be provided over and before and after the rolling mill. In the above, it is difficult to maintain sealing of the gas chamber and the increase in size of the gas chamber increases the consumption of the non-oxidative gas. Therefore, it is preferable to use smaller-sized gas chamber with smaller capacity.

In any case, the strip is generally enclosed by the gas chamber 9 at least up to the pinch rolls 7*a* and 7*b* so that the atmosphere is extremely hot around the pinch rolls 7*a* and 7*b* which convey the strip 4 at a temperature of around 1000° C. Such pinch rolls 7*a* and 7*b* cannot be cooled by cooling water from outside since water-cooling of the pinch rolls 7*a* and 7*b* would cause the gas chamber to be filled with water vapor which would extend to the casting rolls 1*a* and 1*b* and adversely affect the hot strip. To overcome this, the pinch rolls 7*a* and 7*b* have flow paths therein for communication of cooling water so as to attain internal cooling.

On the other hand, the pinch rolls 7*a* and 7*b* used in the twin roll continuous caster have a problem in that the roll surfaces of them tend to roughen in a short period since the pinch rolls 7*a* and 7*b* convey the hot strip of around 1000° C.; and there is a further problem that burning or sticking may occur between the pinch rolls 7*a* and 7*b* and the strip 4. These may lead to a problem that, upon pinching by the pinch rolls 7*a* and 7*b*, roll marks may be formed on the strip 4, resulting in extreme deterioration of surface quality of the strip 4 or failure of obtaining substantial objective products.

Upon occurrence of such problems, the twin roll continuous caster must be stopped in operation to replace the pinch rolls with grinding-finished new pinch rolls for replacement, disadvantageously leading to an increase in the number of line stops needed and lowering of the strip productivity.

Therefore, development of a device has been desired which can be arranged in a narrow space of a gas chamber surrounding a pinch roll unit, permits easy maintenance and can ensure lubrication of a pinch roll to prevent burning or sticking of the pinch roll and prevent roll marks from occurring upon pinching.

SUMMARY OF THE INVENTION

The invention has its object to provide a lubricant mist sprayer for a pinch roll which is simple in structure and made compact in size to be arranged in a gas chamber, permits easy maintenance and can uniformly spray lubricant mist to a pinch roll for lubrication.

The invention is directed to a lubricant mist sprayer for a strip-conveying pinch roll enclosed in a gas chamber of a metal strip continuous caster, characterized in that it comprises a spray header spaced apart by a required distance from and arranged in parallel with a surface of the pinch roll, said spray head having lubricant and gas supply pipes integrally fixed to each other by fixing members, and mist nozzles in the spray header at required intervals longitudinally of said spray heard for spraying lubricant mist over the surface of the pinch roll, said mist nozzles communicating with said lubricant and gas supply pipes.

According to the invention, preferably, said mist nozzles are sealingly connected to oil and gas openings on the lubricant and gas supply pipes via connecting pins fitted through O-rings to the openings, and are fixed to said fixing members by fixing bolts.

Preferably, said lubricant and gas supply pipes are provided with filters.

Preferably, the lubricant supply pipe of said spray head is connected to a lubricant lead-in pipe via a connector extending through the gas chamber, and the gas supply pipe of said spray head is connected to a gas lead-in pipe via a connector extending through the gas chamber so that release of one of the connections with the connectors makes it possible to withdraw said spray head toward a side away from the released side.

BEST MODE FOR CARRYING OUT THE INVENTION

A preferred embodiment of the invention will now be described in conjunction with the drawings.

Figure 1:
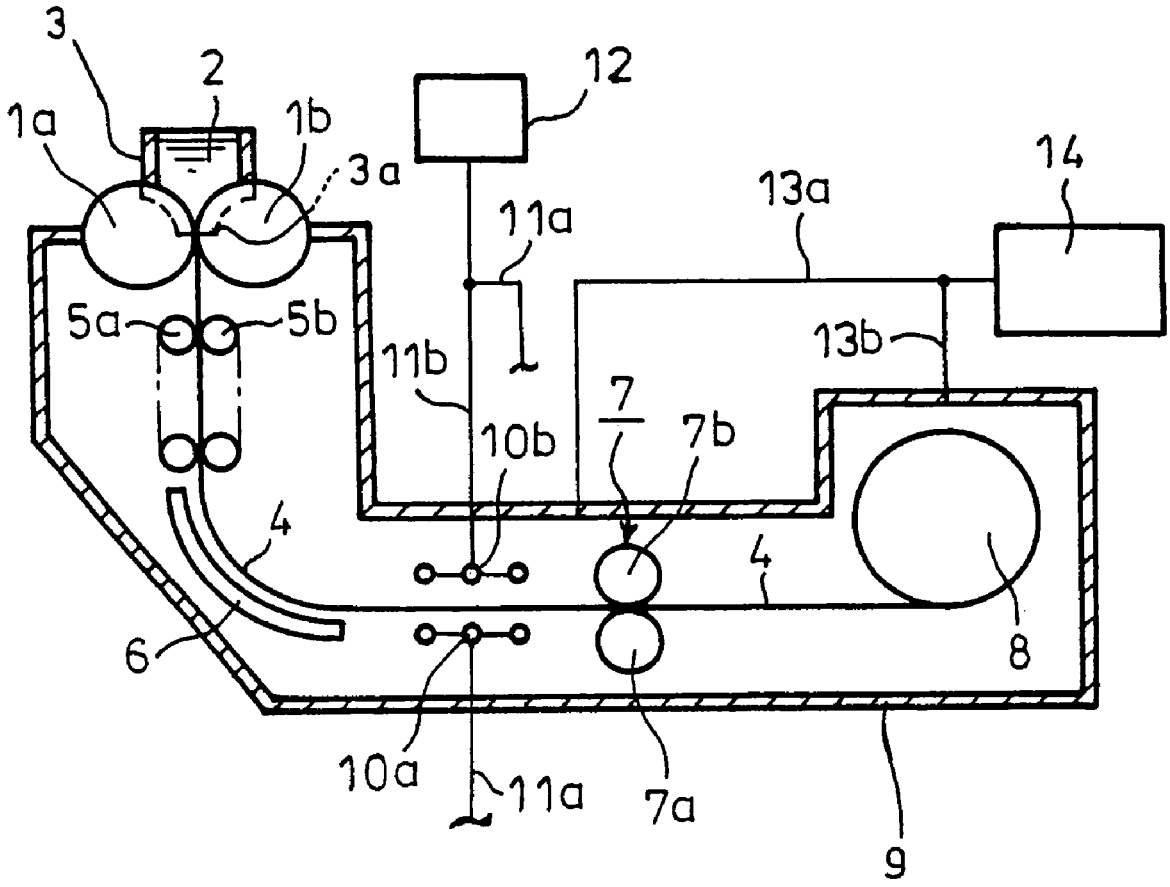
FIG. 1 is a general, schematic side view showing a conventional strip caster.
Figure 2:
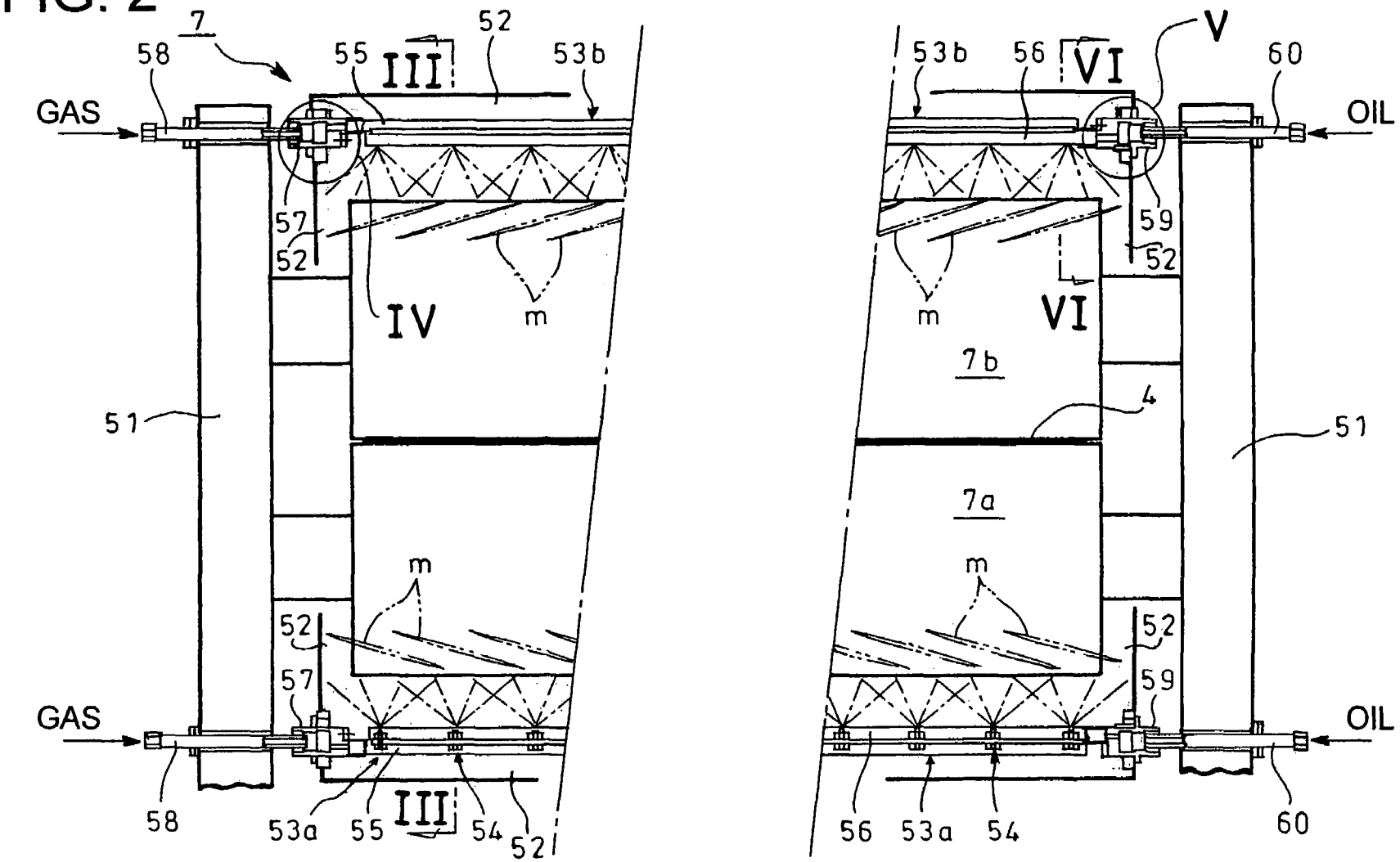
FIG. 2 is a front view showing an embodiment of a lubricant mist sprayer for a pinch roll according to the invention.
Figure 3:
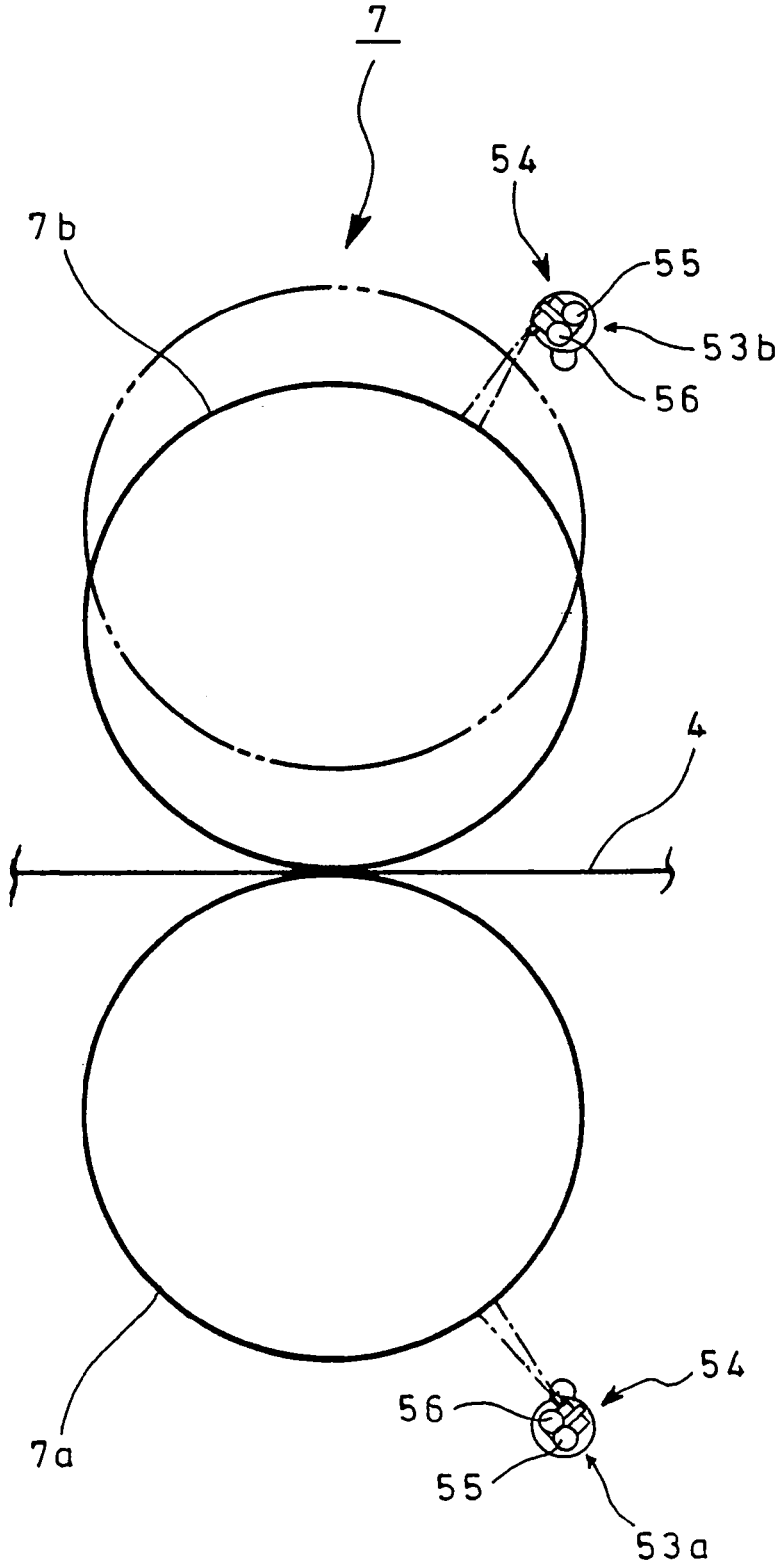
FIG. 3 is a view looking in the direction of arrows III in FIG. 2.
Figure 4:
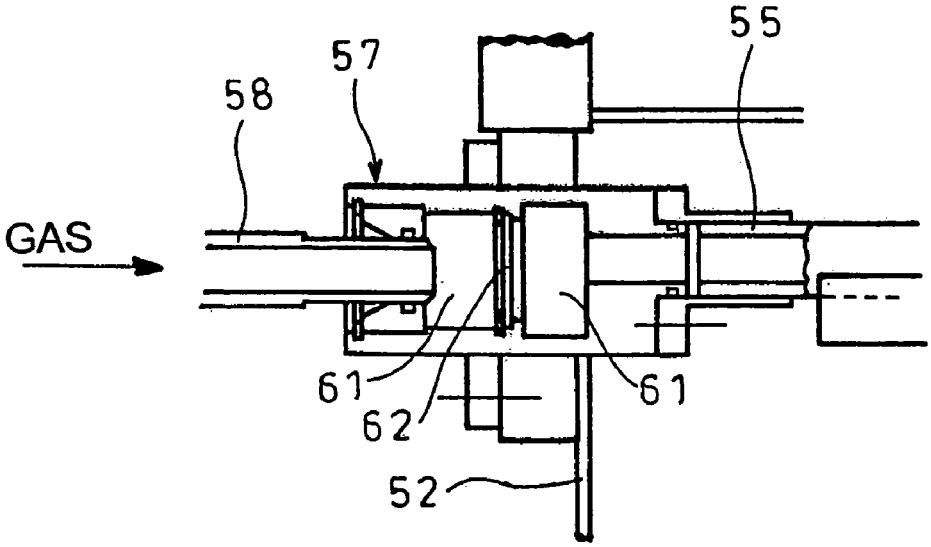
FIG. 4 is an enlarged sectional view showing part IV in FIG. 2.
Figure 5:
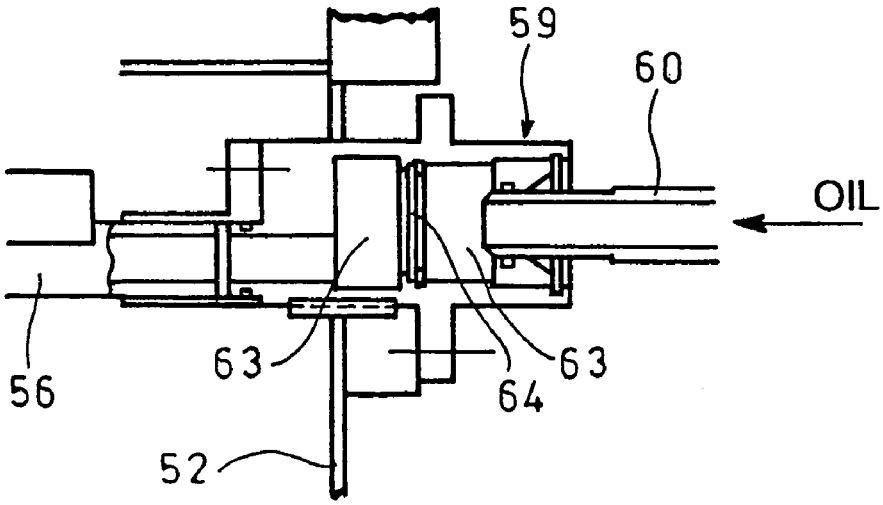
FIG. 5 is an enlarged sectional view showing part V in FIG. 2.
Figure 6:
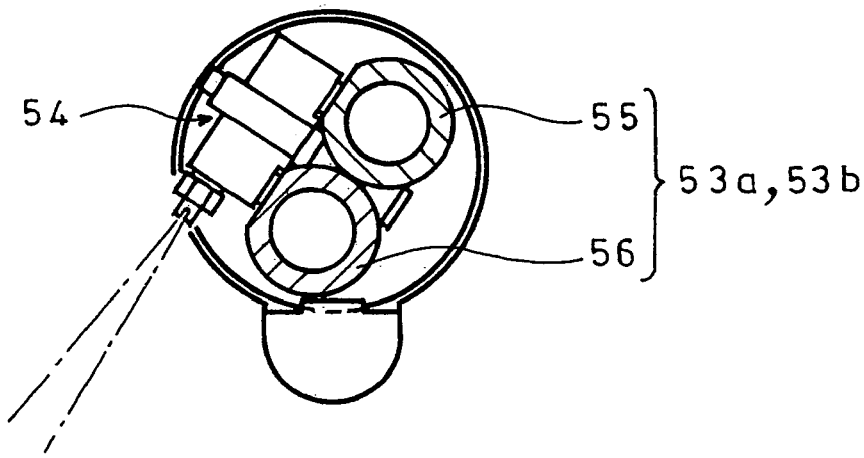
FIG. 6 is a view looking in the direction of arrows VI in FIG. 2.

FIG. 2 is a general front view showing the embodiment of a lubricant mist sprayer for a pinch roll according to the invention; FIG. 3 is a view looking in the direction of arrows III in FIG. 2; FIG. 4 is an enlarged sectional view showing part IV in FIG. 2; FIG. 5 is an enlarged sectional view showing part V in FIG. 2; and FIG. 6 is an enlarged view looking in the direction of arrows VI in FIG. 2.

As shown in FIGS. 2 and 3, a pinch roll unit 7 arranged to convey a strip 4 in a metal strip continuous caster has upper and lower pinch rolls 7*a* and 7*b* rotatably supported to housings 51 by roll chocks (not shown), the upper pinch roll 7*b* being adapted to be vertically moved to pinch the strip 4. The pinch roll unit 7 is provided with a roll chamber 52 which encloses the pinch rolls 7*a* and 7*b* and partly constitutes the gas chamber to maintain a travel path of the strip 4 in non-oxidative atmosphere. The roll chamber 52 is adapted to be cooled through introduction of water in a thickness portion of the same.

With the above-mentioned construction, a lubricant mist sprayer or sprayers are arranged in the roll chamber 52 for the pinch rolls 7*a* and 7*b*. In the embodiment shown in FIGS. 2 and 3, the lubricant mist sprayer is arranged for each of the pinch rolls 7*a* and 7*b*.

The lubricant mist sprayer comprises spray headers 53*a* and 53*b* spaced apart by a required distance from and arranged in parallel with surfaces of the pinch rolls 7*a* and 7*b*, and mist nozzles 54 arranged in each of the spray headers 53*a* and 53*b* at required intervals longitudinally of the headers 53*a* and 53*b*. In the embodiment shown in FIG. 3, the spray header 53*a* is arranged below the lower pinch roll 7*a* off to the right and the spray header 53*b* is arranged above the upper pinch roll 7*b* off to the right.

Each of the spray headers 53*a* and 53*b* has gas and lubricant supply pipes 55 and 56 as shown in FIG. 6. As shown in FIG. 2, each of the gas supply pipes 55 has one end (left end) connected to a connector 57 extending through the roll chamber 52, and has the other end (right end) extending close to the other end of the pinch roll 7*a* or 7*b*. Each of the connectors 57 is connected with a gas lead-in pipe 58 extending through the one (left side) housing 51.

The lubricant supply pipe 56 has the other end (right end) connected to a connector 59 extending through the roll chamber 52 and has one end (left end) extending close to one end of the pinch roll 7*a* or 7*b*. Each of the connectors 59 is connected with a lubricant feed pipe 60 extending through the other (right side) housing 51.

The connector 57 has therein, as shown in FIG. 4, a gas chamber 61 which communicates the gas lead-in pipe 58 with the gas supply pipe 55 and which has therein a filter 62 extending laterally of the chamber 61. The connector 59 has therein, as shown in FIG. 5, a lubricant chamber 63 which communicates the lubricant lead-in pipe 60 with the lubricant supply pipe 56 and which has therein a filter 64 extending laterally of the chamber 63.

Figure 7:
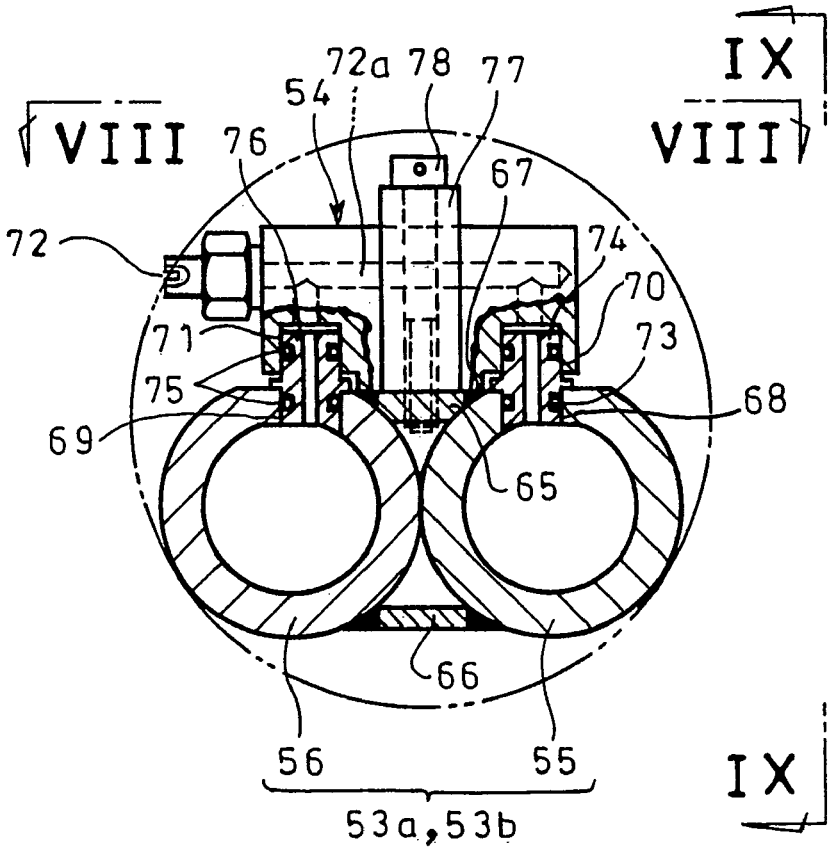
FIG. 7 is a detailed sectional view showing the spray header and the mist nozzle in FIG. 6.
Figure 8:
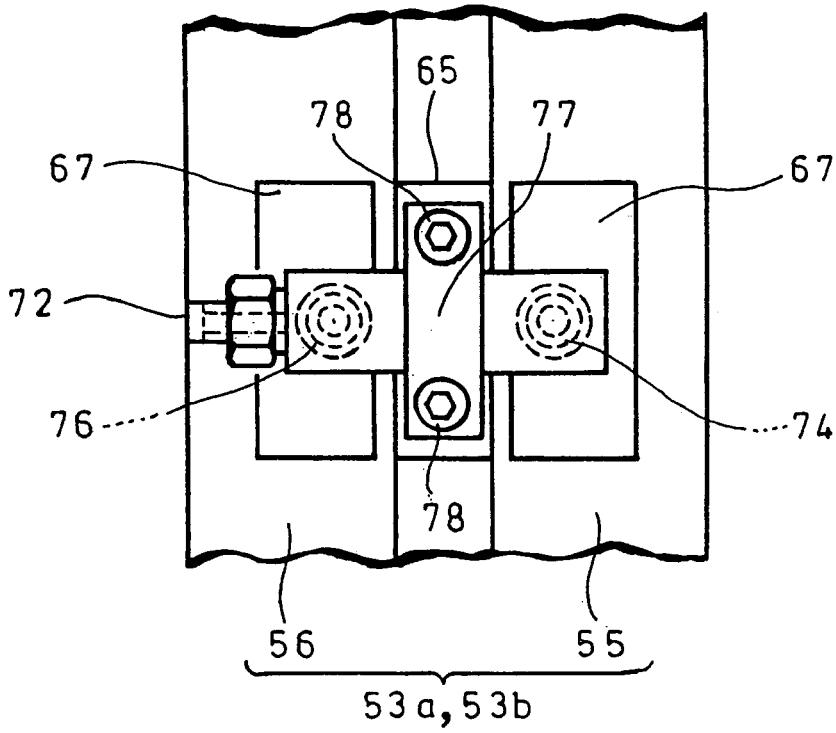
FIG. 8 is a view looking in the direction of arrows VIII in FIG. 7.
Figure 9:
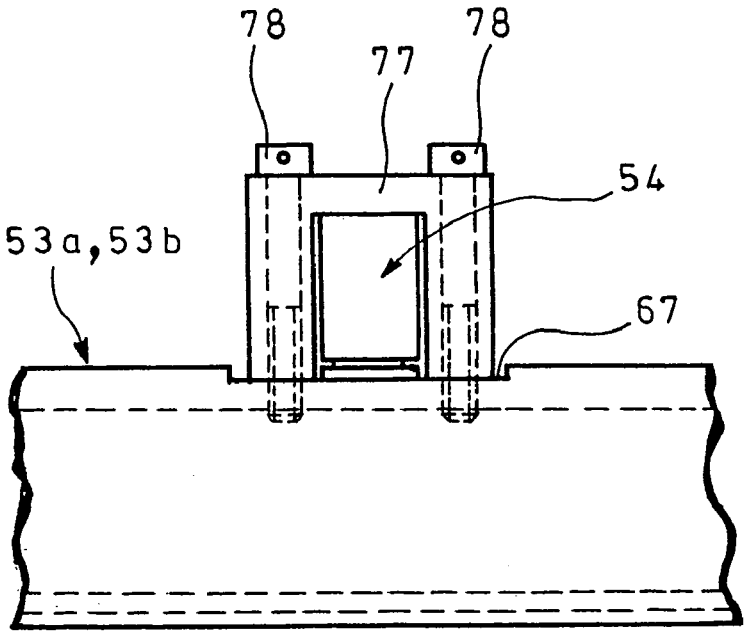
FIG. 9 is a view looking in the direction of arrows IX in FIG. 7.

In each of the spray headers 53*a* and 53*b*, as shown in FIGS. 7–9, the gas and lubricant supply pipes 55 and 56 are arranged with their peripheries being in contact with each other and, at opposite sides of the contact portion, the fixing members 65 and 66 are fixed by welding; these fixing members 65 and 66 are arranged in plural at required longitudinal intervals to thereby integrally assemble the gas and lubricant supply pipes 55 and 56.

At portions on the spray headers 53*a* and 53*b* where the fixing members 65 are arranged, outer surfaces of the gas and lubricant supply pipes 55 and 56 are cut out to provide mounting surfaces 67 coplanar with outer surfaces of the fixing members 65, the mist nozzles 54 being fixed to the mounting surfaces 67.

The mounting surface 67 on the gas supply pipe 55 is formed with upright gas openings 68 in communication with the interior of the gas supply pipe 55; the mounting surface 67 on the lubricant supply pipe 56 is formed with upright oil openings 69 in communication with the interior of the lubricant supply pipe 56.

Each of the mist nozzles 54 is formed with gas and oil communication holes 70 and 71 which are spaced apart from each other by a distance same as that between the gas and oil openings 68 and 69, the gas and oil communication holes 70 and 71 communicate with a mixer passage 72*a* in a body of the mist nozzle 54 which in turn communicates with a nozzle port 72.

Further provided are a connecting pin 74 fitted via O-rings 73 into the gas opening 68 and into the gas communication hole 70 as well as a connecting pin 76 fitted via O-rings 75 into the oil opening 69 and into the oil communication hole 71. With the connecting pins 74 and 76 fitted into the gas opening 68 and gas communication hole 70 and into the oil opening 69 and oil communication hole 71, respectively, the mist nozzle 54 is arranged on the mounting surfaces 67 and is fixed to the mounting surfaces 67 by fixing bolts 78, using a reversed U-shaped fixture 77 fitted over the mist nozzle 54. Thus, the mist nozzles 54 are fixed to the spray headers 53*a* and 53*b*.

The nozzle ports 72 of the mist nozzles 54 are elongate openings for spray of flat oval shaped lubricant mists m to the pinch rolls 7*a* and 7*b* as shown in FIG. 2, the lubricant mists m being sprayed slantwise such that they may be overlapped to one another longitudinally of the pinch rolls 7*a* and 7*b*.

Next, the mode of operation of the above embodiment will be described.

Upon spraying of the lubricant mists m to the pinch rolls 7*a* and 7*b* by the lubricant mist sprayers for the pinch roll unit 7 shown in FIGS. 2 and 3, gas such as $N_2$is introduced via the gas lead-in pipe 58 to the connector 57 to thereby feed the gas to the gas supply pipe 55 while lubricant is introduced via the lubricant lead-in pipe 60 to the connector 59 to thereby feed the lubricant to the lubricant supply pipe 56.

Then, since the gas and lubricant chambers 61 and 63 of the connectors 57 and 59 are provided with the filters 62 and 64, respectively, the gas and lubricant which are cleaned and have no foreign matters are fed to the gas and lubricant supply pipes 55 and 56, respectively, which prevents the mist nozzles 54 from being clogged.

In each of the mist nozzles 54 arranged at the required intervals in the spray headers 53*a* and 53*b*, the gas communication hole 70 sealingly communicates with the gas opening 68 of the gas supply pipe 55 through the connecting pin 74, and the oil communication hole 71 sealingly communicates with the oil opening 69 of the lubricant supply pipe 56 through the connecting pin 76, so that the gas of the gas supply pipe 55 is mixed with the oil of the lubricant supply pipe 56 within the mist nozzle 54 to be sprayed via the nozzle port 72. Then, as shown in FIG. 2, the lubricant mists m sprayed from the respective mist nozzles 54 are overlapped with one another longitudinally of the pinch rolls 7*a* and 7*b*.

In the above-mentioned lubricant mist sprayer, each of the spray headers 53*a* and 53*b* is provided by the integrally assembled gas and lubricant supply pipes 55 and 56, the mist nozzles 54 being arranged at the required intervals in each of the spray headers 53*a* and 53*b*, so that the lubricant mist sprayer can be compact in size and simple in structure and therefore can be readily arranged in the roll chamber 52 which is narrow.

Moreover, the mist nozzle 54 is sealingly connected via the connecting pins 74 and 76 with O-rings 73 and 75 to the gas and oil openings 68 and 69 of the gas and oil supply pipes 55 and 56 and is fixed to the fixing members 65 by the fixing bolts 78, which facilitates mounting operation of the mist nozzles 54 to the spray headers 53*a* and 53*b*.

The spray header 53*a* and 53*b* are straight in shape and the gas and lubricant supply pipes 55 and 56 are connected to the gas and lubricant lead-in pipes 58 and 60 via the connectors 57 and 59, respectively, so that release of either of the connections with the connectors 57 and 59 makes it possible to withdraw the spray header 53*a* or 53*b* from a side away from the released side. This permits easy maintenance of the spray header 53*a* or 53*b*.

As mentioned above, the pinch rolls 7*a* and 7*b* are lubricated by the lubricant mists m uniformly sprayed thereto from the mist nozzles 54 arranged at the required intervals in the spray headers 53*a* and 53*b*, which prevents burning or sticking of the pinch rolls 7*a* and 7*b* and prevents roll marks from occurring upon pinching, thereby reducing the number of line stops to improve the productivity.

It is to be understood that the invention is not limited to the above-mentioned embodiment and that various changes and modifications may be made within the scope and spirit of the invention.

According to the invention, the spray header is constituted by integrally fixing the gas and lubricant supply pipes to each other and the mist nozzles are arranged at the required intervals in the spray header, so that the lubricant mist sprayer can be made compact in size and simple in structure and therefore can be readily arranged within the roll chamber which is narrow.

The mist nozzle is sealingly connected via the connecting pins with the O-rings to the gas and oil openings of the gas and lubricant supply pipes and is fixed to the fixing members by the fixing bolts, which facilitates the mounting operation of the mist nozzle to the spray header.

The gas and lubricant supply pipes are provided with the filters, which prevents the problem of the mist nozzles being clogged.

As mentioned above, the lubricant mists are uniformly sprayed to the pinch rolls by the mist nozzles in the spray headers, which prevents burning or sticking of the pinch rolls and prevents the roll marks occurring upon pinching, thereby reducing number of line stop to improve the productivity.

INDUSTRIAL APPLICABILITY

According to the invention, a lubricant mist sprayer is made compact in size, can be readily arranged in a narrow space of a roll chamber surrounding a pinch roll for a metal strip continuous caster and permits easy maintenance.

The invention claimed is:

1. A lubricant mist sprayer for a strip-conveying pinch roll enclosed in a gas chamber of a metal strip continuous casting apparatus comprising:

a spray header spaced apart by a required distance from and arranged in parallel with a surface of the pinch roll, said spray header having lubricant and gas supply pipes integrally fixed to each other by fixing members, and mist nozzles at required intervals longitudinally of said spray header for spraying lubricant mist over the surface of the pinch roll, said mist nozzles being sealingly connected to oil and gas openings on the lubricant and gas supply pipes via connecting pins fitted through O-rings to the openings, and being fixed to said fixing members by fixing bolts.

2. A lubricant mist sprayer for a strip-conveying pinch roll enclosed in a gas chamber of a metal strip continuous casting apparatus comprising:

a spray header spaced apart by a required distance from and arranged in parallel with a surface of the pinch roll, said spray header having lubricant and gas supply pipes integrally fixed to each other by fixing members, and mist nozzles at required intervals longitudinally of said spray header for spraying lubricant mist over the surface of the pinch roll, said mist nozzles communicating with said lubricant and gas supply pipes, the lubricant supply pipe of said spray header being connected to a lubricant lead-in pipe via a connector extending through the gas chamber, and the gas supply pipe of said spray header being connected to a gas lead-in pipe via a connector extending through the gas chamber so that release of one of the comiections with the connectors makes it possible to withdraw said spray head toward a side away from the released side.

* * * * *